United States Patent [19]

Müller

[11] 4,305,434

[45] Dec. 15, 1981

[54] WEAVING LOOM

[75] Inventor: Jakob Müller, Stansstad, Switzerland

[73] Assignee: Textilma AG, Hergiswil, Switzerland

[21] Appl. No.: 87,636

[22] Filed: Oct. 23, 1979

[30] Foreign Application Priority Data

Oct. 25, 1978 [CH] Switzerland ..... 11014/78

[51] Int. Cl.[3] ..... D03D 47/42

[52] U.S. Cl. ..... 139/431; 139/442

[58] Field of Search ..... 139/431, 432, 440, 441, 139/442

[56] References Cited

U.S. PATENT DOCUMENTS 1,296,024 3/1919 Waite ..... 139/431

3,064,689 11/1962 Piazzolla et al. ..... 139/432

3,104,683 9/1963 Weiner ..... 139/442

*Primary Examiner*—Henry Jaudon

*Attorney, Agent, or Firm*—Michael J. Striker

[57] ABSTRACT

A ribbon loom has a reed drive, a weft-needle drive, an operating needle drive and a shed-forming drive. A main drive shaft carries discs and/or cam discs to which the first-mentioned three drives are directly and articulately coupled. An auxiliary drive shaft extends transverse to the main drive shaft and is connected to the shed-forming drive; it is coupled to the main shaft via a worm transmission the transmission ratio of which can be varied by replacing the worm wheel with a differently dimensioned one.

6 Claims, 4 Drawing Figures

WEAVING LOOM

BACKGROUND OF THE INVENTION

The present invention relates to weaving looms, and more particularly to ribbon-weaving looms.

In prior-art looms of the type in question for instance as disclosed in U.S. Pat. No. 3,104,683 the various moving elements, such as the reed, the weft needle, the working needle and the shed formers, are individually driven via rotating or oscillating intermediate shafts, or else are driven via chains or timing belts. The problem with these solutions is that they are complicated and hence expensive to construct and susceptible to failures. Also, the high rate of wear of the chains or belts makes them economically unattractive in actual operation.

Another difficulty is that when a chain or belt breaks, the mechanism driven by it comes to a standstill and since it is no longer operating in timed coordination with the other mechanisms, it may collide with these other mechanisms with resultant significant damage. However, once the broken chain or belt has been replaced, it is very difficult to so regulate the restarted mechanism that it returns to synchronous cooperation with the other mechanisms of the loom. Aside from all this, chain or belt drives are very noisy and require a high degree of energy imput with a resultant development of heat during operation, so that such looms can operate only at relatively low speeds.

SUMMARY OF THE INVENTION

It is an object of the invention to overcome the disadvantages of the prior art.

A more particular object is to provide a loom of the type in question wherein the problems outlined above are avoided.

In keeping with these objects, and with still others which will become apparent hereafter, one aspect of the invention resides in a ribbon loom having a reed drive, a weft-needle drive, an operating-needle drive and a shed-forming drive, a combination comprising a rotatable main drive shaft, first coupling means mounted on and rotatable with the main drive shaft and being coupled directly to the weft-needle drive, operating-needle drive and reed drive, respectively, a rotatable auxiliary drive shaft coupled to the shed-forming drive, and second coupling means directly coupling the auxiliary drive shaft to the main drive shaft to receive rotation therefrom.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
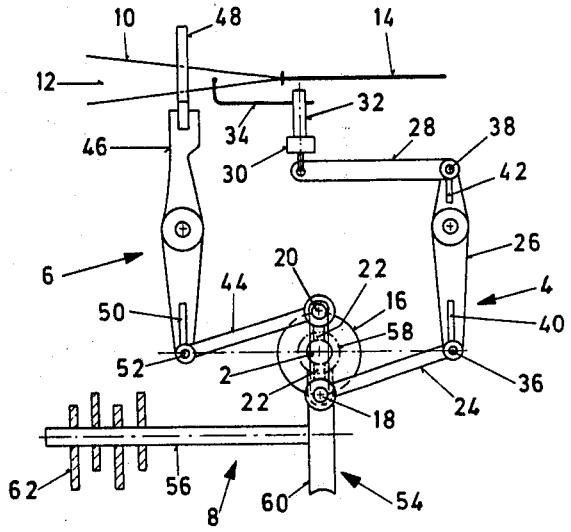
FIG. 1 is a diagrammatic side view, partly in section, showing the contra-operating drives of a reed and of a weft needle in conjunction with a shed-forming drive of a needle-type ribbon loom.
Figure 2:
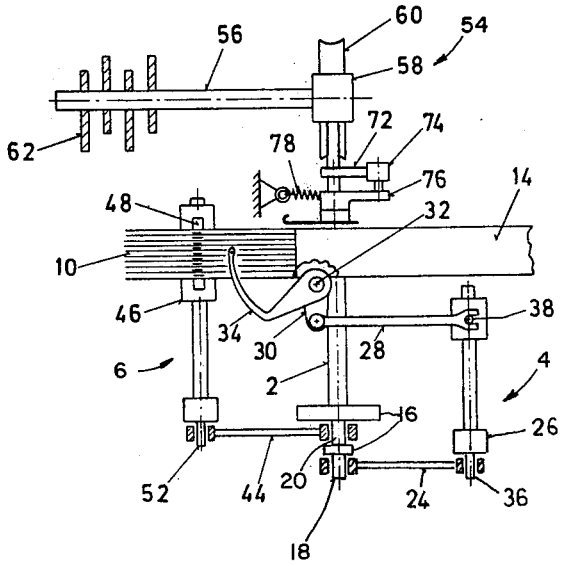
FIG. 2 is a top plan view of the embodiment shown in FIG. 1.

A first embodiment of the invention is illustrated in FIGS. 1–2 which show a rotatable main drive shaft 2 to which there are connected (so as to be driven by shaft 2) a weft needle drive 4, a reed drive 6 and a shed-forming drive 8. Reference numeral 10 designates the warp threads, numeral 12 the warp shed and numeral 14 the woven ribbon.

The weft needle drive 4 and the reed drive 6 are both powered by a crank disc 16 which is mounted on the shaft 2 for rotation with the same, and which is provided at diametrally opposite locations with crank pins 18 and 20. The disc 16 has radial slots 22 in which these crank pins 18, 20 can be shifted towards and away from the axis of rotation of shaft 2, and arrested at desired locations by means known per se and hence not illustrated.

The crank pin 18 is articulated to a rod 24 which in turn is articulated to one end of a swing arm 26, the other end of which is articulated to a rod 28 which connects it to another swing arm 30 (see FIG. 2). Swing arm 26 has longitudinally extending guide slots 40, 42 in which the pivots 36 and 38 which connect it to the rods 24 and 28, respectively, can be moved lengthwise and arrested (by means known per se) at desired locations; this permits selection of the effective length of the swing arm 26 and enables the starting position and stroke of the needle 34 to be adjusted. The swing arm 30 is mounted on a shaft 32 for rotation therewith, and the needle 34 is carried and driven by the shaft 32 (see especially FIG. 1).

The reed drive 6, on the other hand, has a rod 44 which is articulated to the crank pin 20 and the other end of which is articulated via pivot 52 to one end of a swing arm 46 which carries at its other end the reed 48. The end of swing arm 46 to which rod 44 is coupled is provided for the arrestable pivot 52 with a longitudinal guide slot 50 similar to and for the same purposes as those in swing arm 26 (except that here, of course, the stroke and position of reed 48 are being adjusted).

The loom further has an auxiliary shaft 56 which is coupled to the main shaft 2 via a single-stage transmission 54; shaft 56 powers the shed-forming drive 8. The transmission 54 has a worm 58 which is mounted on and turns with the main shaft 2, and which meshes with a worm wheel 60 mounted on the auxiliary shaft 56 for rotation with the same. The drive ratio of the transmission 54 is currently preferred to be 1:8 but can be changed to another desired ratio by exchanging the worm wheel 60 for a different one. Shaft 56 is inclined relative to the shaft 2, preferably at an angle of 90°. The shaft 56 carries a plurality of eccentrics 62 which drive, in a manner and for purposes known per se and not forming part of the invention, other shafts of the loom (not shown).

Figure 3:
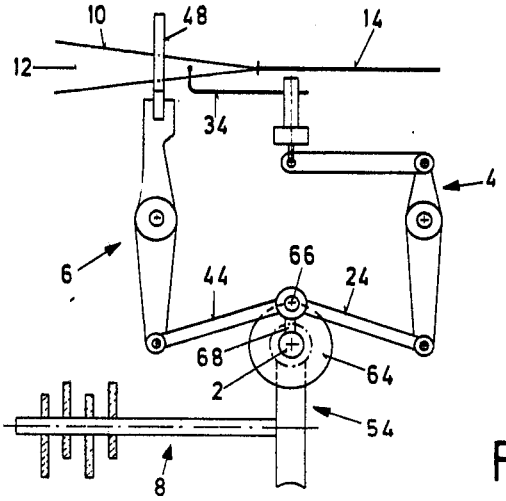
FIG. 3 is a diagrammatic side view, partly in section, showning the parallel-operating drives of a reed and of a weft needle in conjunction with a shed-forming drive of a needle-type ribbon loom.

The weft needle drive and the reed drive 6 in FIGS. 1–2 operate counter to one another, by virtue of the manner in which they are connected to the disc 16. In the embodiment of FIG. 3, however, in which like reference numerals identify like elements as in FIGS. 1–2, these drives 4 and 6 operate in one and the same direction, i.e. they operate in parallel.

For this purpose the shaft 2 in FIG. 3 carries a disc 64 which is provided with only one radial groove 68 and with only one crank pin 66 which is adjustable lengthwise (and arrestable) in the groove 68. Both the rod 24 of drive 4 and the rod 44 of drive 6 are articulated to this one crank pin 66. In all other respects this embodiment corresponds to the one in FIGS. 1–2.

Figure 4:
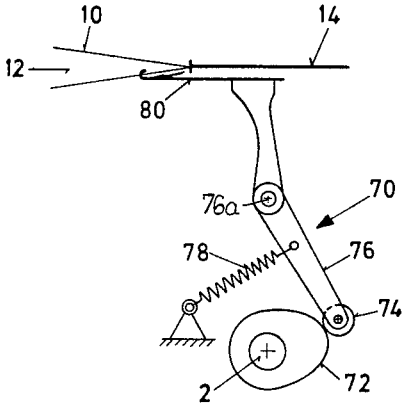
FIG. 4 is a side view of an operating needle drive.

A drive 70 for the operating needle of the loom is shown in FIGS. 2 and 4. It includes an eccentric cam 72 which is mounted on main shaft 2 for rotation with the same. A follower 74 mounted on one end of a double-armed lever 76 tracks the cam 72 under the influence of a biasing spring 78; lever 76 is pivoted at 76*a* so as to swing about an axis parallel to the axis of shaft 2. The other end of lever 76 carries the operating needle 80 (FIG. 4) which engages, in a manner known per se, one side of the ribbon 14 being loomed and serves to catch the inserted weft loops.

Due to the fact that at least the drives 4, 6 and 70 are directly powered by discs, respectively cams, mounted on the main drive shaft 2, the heretofore needed chain or belt drives can be omitted, together with the bearings and drives required for them. The construction is therefore much simpler and more compact than was previously possible. Moreover, a loom embodying the invention operates much more quietly than before and the drives are less susceptible to malfunction and more readily adjustable.

A further advantage of the invention is that the moving masses can be better compensated than previously possible; this reduces vibrations and permits higher operating speeds while, at the same time, reducing wear of the moving parts to a minimum. Since the several drives are each individually coupled to the main drive shaft 2, any tendency of one drive to influence another is largely avoided, e.g. vibrations of the reed cannot be transmitted to another element, such as the weft needle.

The connection of the auxiliary shaft 56 with the main shaft 2 prevents inadvertent reverse movements of loom components and thus suppresses the heretofore common occurrence of weaving faults on stopping or starting of the loom. Having the drives 4 and 6 operate contra to one another as in FIGS. 1–2 has the advantage that the mass forces of the moving parts are largely compensated and a particularly vibration-free operation is obtained. The parallel movement of the drives 4 and 6 as shown in FIG. 3, on the other hand, produces a particularly good weave geometry. The use of the swing arms with the adjustable pivots permits the stroke of the individual operating elements to be adjusted—even to be adjusted from a central location—and the manner of driving the weft needle as shown in FIGS. 1–2 is particularly simple and permits fine-adjustment of the needle operation over a wide operating range.

While the invention has been illustrated and described as embodied in a needle-type ribbon loom, it is not intended to be limited to the details shown, since various modifications and structural changes may be made without departing in any way from the spirit of the present invention Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A ribbon loom having a rotatable main drive shaft oriented transversely to warp threads of the processed product; a reed drive, a weft needle drive and an operating needle drive said operating needle drive including a double armed lever driven by means on said main drive shaft; said reed drive and said weft needle drive including a swing lever, respectively; crank means mounted on said main drive shaft and having at least one crank; means for linking the swing levers of said reed and weft needle drives to said crank means; and a shed forming drive including a rotatable auxiliary shaft and transmission gears coupling said main drive shaft to said auxiliary shaft.

2. A ribbon loom as defined in claim 1, wherein said crank means include two diametrally opposed cranks, and said linking means including two rods for linking the swing lever to said reed drive to one crank and the swing lever of said weft needle drive to the other crank.

3. A ribbon loom as defined in claim 2, wherein the position of said cranks relative to said main drive shaft is adjustable.

4. A ribbon loom as defined in claim 2, wherein said auxiliary shaft is oriented transversely to said main drive shaft and said transmission gears are worm gears.

5. A ribbon loom as defined in claim 2, wherein the effective length of at least one of said swing levers is adjustable.

6. A ribbon loom as defined in claim 2, wherein said weft needle drive linkage includes an additional rotary shaft for supporting the weft needle, an additional swing lever fixed to said additional shaft, said swing lever having two arms, one of said arms being linked to one of said cranks and the other arm being linked by an additional coupler to said additional swing lever, and the effective length of said other arm being adjustable.

* * * * *